US005293900A

United States Patent [19]

Karbassi et al.

[11] Patent Number: 5,293,900

[45] Date of Patent: Mar. 15, 1994

[54] JOYSTICK WITH CONTACTLESS DIRECT DRIVE DEVICE

[75] Inventors: Hassan Karbassi, Hartland; Edward T. Heck, Waukesha, both of Wis.

[73] Assignee: Hydro Electronic Devices Inc. (HED), Hartland, Wis.

[21] Appl. No.: 954,555

[22] Filed: Sep. 30, 1992

[51] Int. Cl.[5] ..... F16K 37/00

[52] U.S. Cl. ..... 137/554; 137/607; 74/471 X; 345/161

[58] Field of Search ..... 137/554, 637; 340/709; 74/471 XY

[56] References Cited

U.S. PATENT DOCUMENTS

| | | | |
|---|---|---|---|
| 4,646,087 | 2/1987 | Schumann . | |
| 4,646,778 | 3/1987 | Tsuji et al. | 74/471 XY |
| 4,656,461 | 4/1987 | Morsch et al. | 74/471 XY |
| 4,825,157 | 4/1989 | Mikon | 340/709 |

OTHER PUBLICATIONS

P-Q Controls, Inc. Multi-Axis Sales Brochure, Jun. 1988.

OEM Controls, Inc. sales Brochure, Oct. 1988.

Penny & Giles Potentiometers Limited Specification Sheet, HVC2/Aug. 1986.

Apitech Electronic Controller Specification Sheet Nos. 20-677 and 20-680, Jan. 1985.

*Primary Examiner*—A. Michael Chambers

*Attorney, Agent, or Firm*—Nilles & Nilles

[57] ABSTRACT

A direct drive joystick has a contactless system for sensing the position of the joystick lever and having valve drivers which are positioned within the joystick, and which are directly connected to coils of a proportional valve. The joystick thus is not prone to failure due to internal friction of its sensing elements and at the same time is capable of directly driving valves without the provision of any other devices between the joystick and the valves. The joystick including the valve driver is rugged, compact and can be easily installed. The valve driver can be adjusted by an operator who is simultaneously actuating the joystick. The operational status of one or more of the joystick, the valve being controlled by the joystick, and the power source for the valve and joystick are visually displayed at a location which can be easily viewed by the joystick operator. Operation of the valve driver and thus of the joystick is prevented upon failure of a signal wire or upon generation of a joystick fault signal.

22 Claims, 6 Drawing Sheets

JOYSTICK WITH CONTACTLESS DIRECT DRIVE DEVICE

BACKGROUND OF THE INVENTION

1. Field of the Invention

The present invention relates to joysticks and, more particularly, relates to joysticks for electronically actuated proportional valves which control heavy industrial equipment.

2. Description of the Related Art

A wide variety of industrial devices and vehicles employ electronically actuated proportional valves to perform functions of the devices. Such valves may directly control the operation of a device such as a hydraulic piston and cylinder arrangement. Such valves may also indirectly control the operation of a device such as a hydrostatic transmission. Many such valves have two or more coils permitting the valves to be positioned in any activation state.

These industrial valves are typically actuated by moving a joystick through one of a plurality of axes. The typical joystick includes a pivotable lever coupled to a potentiometer which generates an output signal representative of the position and/or rate of motion of the joystick. The output of the potentiometer is in turn transmitted to the coil of a servo or solenoid valve to actuate the valve. Joysticks employing potentiometers to detect the operational state of the joystick lever exhibit several disadvantages. For instance, such potentiometers, while varying greatly in construction, all utilize the direct interface of a stationary conductor and a movable wiper in electrical contact with one another. These potentiometers are subject to rapid wear when used in environments that undergo high vibration such as that found on mobile equipment such as cranes. More specifically, the potentiometer wipers will continuously reciprocate through a small distance due to the vibration of the device on which it is mounted. This movement quickly degrades or wipes off the lubricant between the stationary element and the wiper, leading to relatively rapid wear and failure of the potentiometer and thus of the joystick. Even so called "non-lubricated" plastic resistive element-type potentiometers will incur this type of failure. Signal generators employing potentiometers also employ relatively complex drive systems incorporating various gears, cam followers, etc. Such mechanisms are relatively bulky, expensive and difficult to assemble, and prone to failure.

Some of the problems associated with potentiometer-type detection circuits can be eliminated through the provision of so-called "contactless" sensors. These sensors do not require direct electrical contact between the actuating lever and the signal generator and thus are not as prone to failure.

One such contactless position detector comprises a so-called "inductively coupled" position detector, otherwise known as a "linear induction sensor". The typical inductively coupled position detector employs a transmitting or drive coil positioned on the end of the joystick lever and a plurality of pickup or sensor coils which are positioned proximate the transmitting coil and which generate an electrical signal when a transmitting coil moves into the proximity of one of the respective pickup coils. These signals are transmitted to a circuit board and combined so as to provide a signal indicative of the position of the joystick.

While contactless detection systems such as inductively coupled position detectors avoid many of the problems associated with the use of potentiometer-type detectors, these detectors do not generate a current of a sufficient magnitude to actuate electrically operated proportional valves and thus require the provision of valve drivers which receive the signals generated b the position detector and which generate an electric current of sufficient magnitude to actuate a valve. These valve drivers are typically provided on circuit boards and are sometimes known as drive boards.

Heretofore, valve drivers have been provided as modular units at a location between the joystick and the valves to be actuated. Such externally positioned valve drivers exhibit several disadvantages.

For instance, systems employing separate modular joysticks and valve drivers are relatively bulky and require independent mounting of the joystick and valve driver modules. The valve driver modules are often placed in a location which is open to the elements, and are thus subject to damage through crushing, water damage, etc.

Valve drivers located remote from the position detector are also prone to interference because the relatively long electrical connections joining these elements tend to act as antennas which pick up electrical interference signals. These connections are also exposed to the elements and are thus prone to breakage.

Moreover, it is often necessary to adjust the operational parameters of the valve driver to meet a particular application. For instance, it may be necessary to set the maximum voltage level for full joystick displacement or to set a designated voltage increase rate or ramp rate for a particular application. Such adjustments are most easily performed during operation of the joystick. However, if the valve driver is located remote from the joystick, such simultaneous adjustments cannot be performed by a single operator. It is therefore necessary to employ a first operator to operate the joystick and another operator to adjust the valve driver. Similarly, although some systems employ diagnostic visual indications of the status of the system, such indicators are not mounted on the joystick and thus may not be positioned in a location which can be easily viewed by the user while operating the joystick.

The typical joystick also is incapable of responding to a signal wire failure or to a joystick fault in which the valve being controlled is not completely de-energized when the joystick is in its neutral position. Failure of a system to respond to either of these conditions is potentially hazardous because it may lead to unintended partial or complete actuation of a valve and of the implement being controlled by the valve.

OBJECTS AND SUMMARY OF THE INVENTION

It is therefore an object of the invention to provide a joystick which is rugged, compact, and easy to install.

It is another object of the invention to provide a joystick having a valve driver the operational parameters of which can be manually adjusted while simultaneously operating the joystick.

In accordance with the present invention, these and other objects of the invention are achieved by providing a joystick including a housing, an actuating lever attached to the housing, a contactless detector, located within the housing, which detects an actuating state of the lever and which generates a signal representative of the actuating state, and a valve driver which is responsive to the signal generated by the detector and which is provided in the housing. The valve driver preferably comprises a circuit provided in the housing beneath the sensor.

In accordance with another aspect of the invention, the joystick further includes devices, provided in the housing, for adjusting the operational parameters of the valve driver. Advantageously, holes can be provided in a side wall of the housing proximate the valve driver, and the adjustment devices comprise screws which are aligned with the holes in the side wall of the housing.

In accordance with yet another aspect of the invention, a status indicator is provided in the housing and provides an indication of the operational status of the valve driver. The status indicator may comprise an LED light.

It is still another object of the invention to prevent or to at least inhibit undesired operation of the valve or valves being serviced by the joystick.

In accordance with this aspect of the invention, a system is provided including a housing, an actuating lever attached to the housing, and a contactless detector, located within the housing, which detects an actuating state of the lever and which generates a signal representative of the actuating state. A valve driver is responsive to the signal generated by the detector and includes at least one of (i) means for preventing the valve driver from generating an output signal in the presence of a signal wire defect, and (ii) means for preventing the valve driver from generating an output signal during system failure.

The valve driver may comprise a hard-wired circuit board which produces an analog signal. The means (i) may comprise a comparator and a reference voltage circuit connected to the comparator, and the means (ii) may comprise a joystick fault interface.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being made to the accompanying drawings in which like reference numerals represent like parts throughout, and in which.

DETAILED DESCRIPTION OF THE PREFERRED EMBODIMENT

Pursuant to the invention, a joystick is provided having a contactless system for sensing the position of the joystick lever and having valve drivers which are positioned within the joystick and which are directly connected to proportional valve coils. The joystick thus is not prone to failure due to internal friction of its sensing elements and at the same time is capable of directly driving proportional valves without the provision of any other devices between the joystick and the valves. The joystick including the valve driver is rugged, compact and can be easily installed. The valve driver can be adjusted by an operator who is simultaneously actuating the joystick. The operational status of one or more of the joystick, the valve being controlled by the joystick, and the power source for the valve and joystick are visually displayed at a location which can be easily viewed by the joystick operator. Operation of the valve driver and thus of the joystick is prevented upon failure of a signal wire or upon generation of a joystick fault signal.

PHYSICAL CONSTRUCTION

Figures 1, 2:
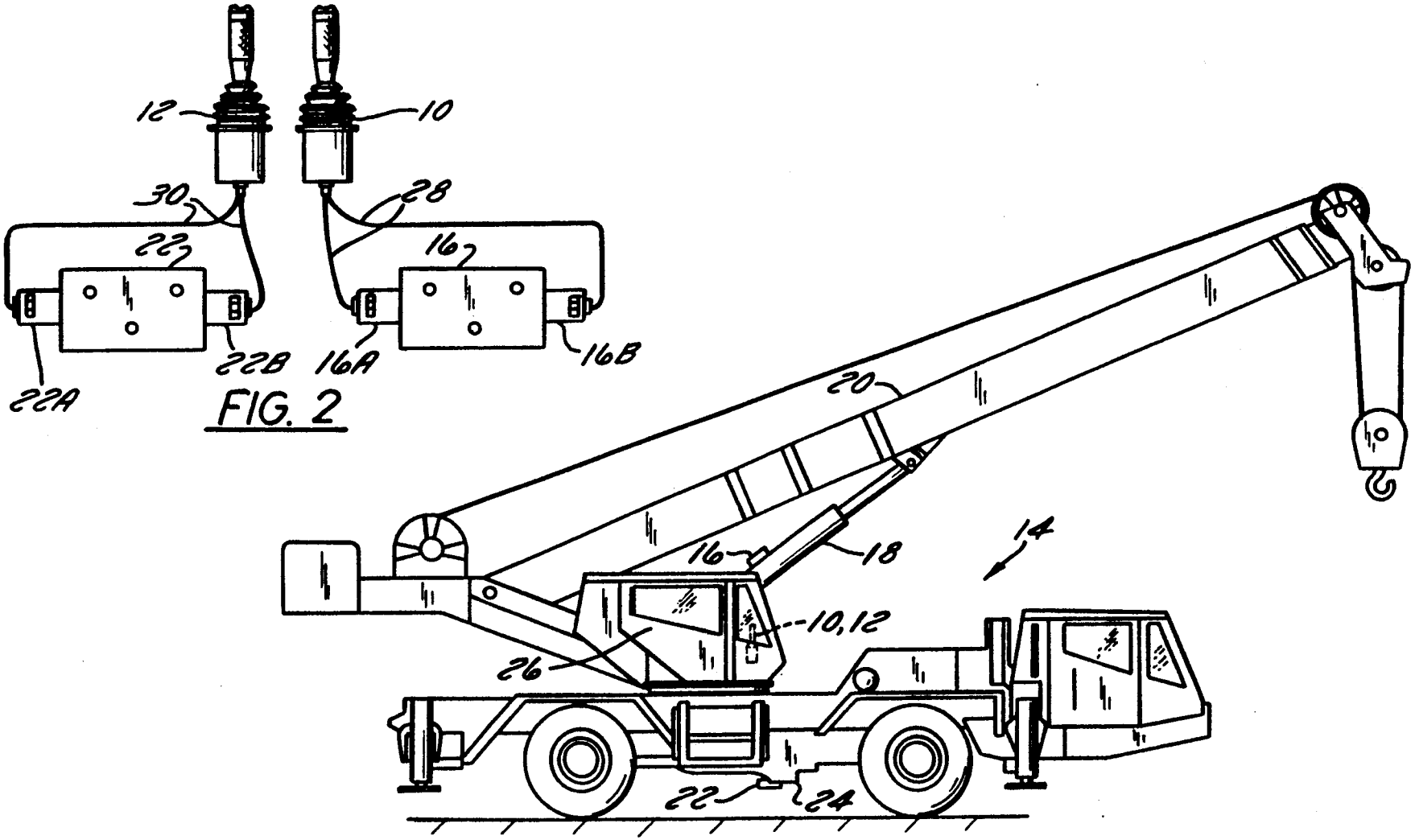
FIG. 1 schematically illustrates a crane incorporating direct drive joysticks constructed in accordance with a preferred embodiment of the invention.
FIG. 2 illustrates the connections of the joysticks of claim 1 to proportional valves of the crane.

Referring to FIGS. 1 and 2, joysticks 10 and 12 constructed in accordance with the present invention are typically employed to control the operation of components of heavy industrial equipment such as a crane 14. In the illustrated embodiment, joystick 10 supplies actuating signals to the coils 16A and 16B of a proportional valve 16 controlling the operation of a piston and cylinder device 18 via cables 28. Piston and cylinder device 18 in turn raises and lowers a boom 20 of the crane 14. Joystick 12 is electrically coupled to the coils 22A and 22B of a proportional control valve 22 of a hydrostatic transmission 24 via cables 30. The joysticks 10 and 12 may be provided in the cab 26 of the crane 14 where they are protected from the elements and where they are easily accessible by the crane operator.

The joysticks 10 and 12 are of identical construction. Accordingly, the following detailed description of joystick 10 is equally applicable to joystick 12.

Referring to FIGS. 3-6, joystick 10 includes a cylindrical housing 32 having inner and outer housing portions 32B and 32A and a flange 32C for mounting the joystick on a suitable panel or frame of the crane 14. A lever 34 protrudes out of the housing 32 and is pivotally attached to the housing via a ball and socket connection 36 so as to move in the direction of arrow 34A in FIG. 4 from a neutral or rest position 34B to fully actuated positions 34C and 34D. Movement towards position 34C actuates coil 16A of valve 16, and movement towards position 34C actuates coil 16B of valve 16. A protective boot 38 extends from a grip portion 40 of lever 34 to the top of the housing 32 and permits movement of the lever relative to the housing 32 while preventing dirt and dust from invading the housing. Switches 41A, 41B may be provided to control devices in addition to those controlled by joystick lever 34 or to enable a disable response to the joystick lever.

The position and/or rate of movement of lever 34 is detected by a contactless detector 42 which generates an actuation state signal and transmits this signal to valve drivers 44A and 44B. Valve drivers 44A and 44B generate actuating or output signals in response to the signal generated by the detector 42 and transmit these signals to the actuating coils of respective valves. In the illustrated embodiment, valve driver 44A is electrically coupled to the coils 16A and 16B of valve 16, and valve driver 44B is connected to the coils of another valve (not shown). Valves having more or less than two coils could also be actuated by valve drivers constructed in accordance with the present invention.

Contactless detector 42 could be any of a variety of position, motion, and/or force sensors. For instance, the detector could comprise a linear Hall-effect sensor, an optical sensor, a piezoelectric sensor, or a system of strain gauges. However, the illustrated embodiment employs a linear induction sensor having a primary or transmitter coil 45 which is inductively couplable to any of a plurality of secondary or pickup coils 46.

The construction and operation of linear induction sensor 42 are well known in the art and thus will not be discussed in great detail. Suffice it to say that the primary coil 45 is excited with a signal having a fixed sinusoidal wave form and transmits a signal inducing voltages in pickup coils 46. The pickup coils 46 are arranged and interconnected such that the mathematical sum of the induced voltages will be of the magnitude and polarity which is indicative of the position o primary coil 45 and thus of the lever 34. In the illustrated embodiment, the generation of the position signal in response to the current induced in the secondary coils 46 is generated on a circuit board 48 in a manner which is, per se, well known.

Valve drivers 44A and 44B receive the signals generated by the linear induction sensor 42 and transmit output signals of sufficient current and voltage to actuate the coils A and B of the respective valves as discussed above. Valve drivers 44A and 44B are secured in the housing 32 immediately beneath circuit board 48 via suitable connectors such as pins 47. The output signals are generated by the valve drivers via analog or digital control circuitry 50 discussed in more detail below.

By providing the valve drivers 44A and 44B in the housing 32 and dimensioning these drivers to be of approximately the same diameter as the circuit board 48 as illustrated, the need for constructing and installing separate joystick and valve driver modules is obviated. Although two valve drivers are illustrated, it should be noted that any number of valve drivers could be stacked within the housing 32 one beneath the other, thus enabling the control of many valves with a single direct drive joystick. Each valve driver could include circuitry for energizing any number of valve coils. The resulting device is very compact and can be easily installed as a unit.

Stacking the valve drivers 44A and 44B within housing 32 also enables the use of relatively short signal wires 52 connecting the circuit board 48 to the valve drivers 44A and 44B. Because these wires are very short and are protectively encased within housing 32, they are much less prone to failure and to interference from outside electrical sources than are wires leading to external valve drivers. Ruggedness is also enhanced because the valve drivers 44A and 44B are also protectively enclosed in housing 32. Installation is facilitated because the entire joystick/valve driver assembly can be installed simply by attaching flange 32C of housing 32 to a suitable support.

As discussed above, it is often necessary to adjust the operational parameters such as the threshold and maximum currents and the rate of current increase of valve drivers 44A and 44B to meet the requirements of a particular application. In the illustrated embodiment, the operational parameters of that portion of each valve driver controlling each of the coils of respective valve can be controlled individually by rotating screws 60A–72A and 60B–72B which are provided on the valve drivers 44A and 44B and which are aligned with mating holes in the outer housing portion 32A. In the illustrated embodiment, only the upper valve driver 44A connected to valve 16 is adjustable, the lower valve driver having been preset and the corresponding holes in housing portion 32A covered or plugged.

Of the screws 60A–72A, a first group 60A–64A of screws is used to adjust various parameters of that portion of the valve driver 44A which controls the left coil 16A of valve 16, and a second group 66A–70A is used to adjust parameters of that portion of valve driver 44A which controls the right coil 16B. Screw 72A is used to adjust the frequency response of the valve driver 44A. The manner in which these parameters may be adjusted is, per se, well known and will be discussed in greater detail below. Some examples of adjustment will be provided to explain the importance of employing adjustable valve drivers.

For instance, many hydraulic devices utilize pulse width modulation s that the fluid flowing through the valve undergoes micro vibrations to keep a hydrodynamic film on mechanical parts such as those in the hydrostatic transmission 24 supplied by valve 22. If the frequency is too low due to an overly wide pulse width, hydraulic shock may form in the line downstream of the valve due to relatively large pulses of fluid or pressure to the line. If the pulse frequency is too high, the mechanical valve components may lack sufficient response characteristics to move at the commanded rate. Thus, the valve may stick open, thereby producing large hysteresis and a substantially constant flow rate. The optimum pulse frequency varies with valve construction and with the hydrodynamic properties of the system controlled by the valve. Thus, the parameters of the valve driver must be varied to adjust the pulse frequency of the valve to provide the optimum pulse frequency.

It may also be desirable to set a valve driver to provide different threshold voltages to the coils of a valve to control a counterbalanced valve having a significantly higher threshold pressure or flow rate in a first direction than in a second direction. For instance, in the disclosed embodiment, valve 16 may be controlled as a counterbalanced valve so that the cylinder 18 does not retract unless the pressure on the opposite end port of the valve 16 is sufficiently high to provide a small pressure differential across the valve which provides controlled lowering of the boom 20. The maximum flow rate of hydraulic fluid through the left and right sides of the valve 22 of hydrostatic transmission 24 could also be individually adjusted to provide a reverse speed and/or acceleration which are lower than the forward speed and/or acceleration.

Pursuant to the invention, the valve drivers and thus the adjustment screws for the valve drivers are provided in the housing 32 of the joystick 10. Accordingly, it is possible for the user to operate the joystick while he or she simultaneously adjusts the parameters of the valve drivers. This in turn permits the operator to utilize the instantaneous feedback of the system to quickly set the operation of the device being controlled by the joystick to the desired parameters without requiring any assistance from any other personnel.

Visual indicators in the form of LED's 80, 82, 84, and 86 are also provided on the valve drivers in the housing 32 to apprise the operator of the operational status of the power source, the joystick 10, and/or the valve drivers 44A and 44B.

For example, these LED's could be placed on the valve drivers 44A and 44B in parallel with the valve coils to provide a visual indication which varies in intensity with the voltage being output by the valve driver thus indicating the degree at which a valve is open. Such LED's could also provide a visual diagnostic of the system. For instance, if an LED is lit when the joystick lever is actuated but the valve is not actuated, the operator will be apprised that there is a fault between the valve driver and the valve. On the other hand, if the LED is not lit when the joystick lever is actuated, the operator will be apprised that there is a fault in the circuitry of the joystick or of its power supply.

By placing LED's on the housing 32 of joystick 10, the need for assembling and installing separate indicator modules is eliminated and a diagnostic system is provided which is easily monitored by the user while operating the joystick.

ELECTRONIC CONTROL SYSTEM

As discussed above, each of the valve drivers 44A and 44B receives signals generated by the linear induction sensor or other contactless detector 42 and utilizes circuitry 50 to combine these signals to generate actuating signals for the respective coil of a hydraulic proportional valve. Although a wide variety of analog and/or digital circuitry could be provided to accomplish this purpose, it is preferable that certain control functions and/or safety features be wired or programmed into the valve driver. Accordingly, representative examples of analog and digital control systems operable at least in part as the circuitry 50 of FIGS. 4 and 5 will now be described.

1. Analog Control System

Figure 6:
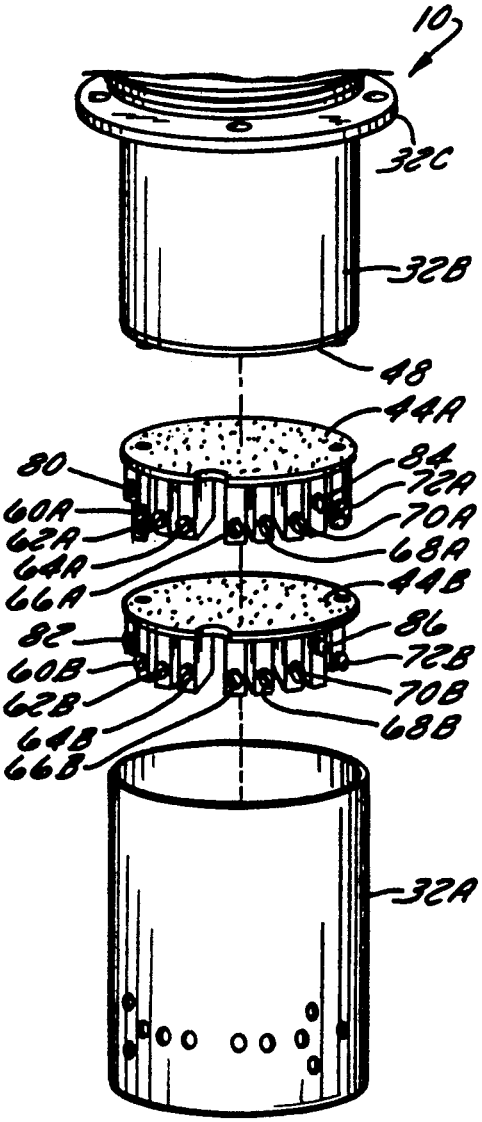
FIG. 6 is a partially exploded perspective view of the joystick of FIGS. 3-5.
Figure 7A:
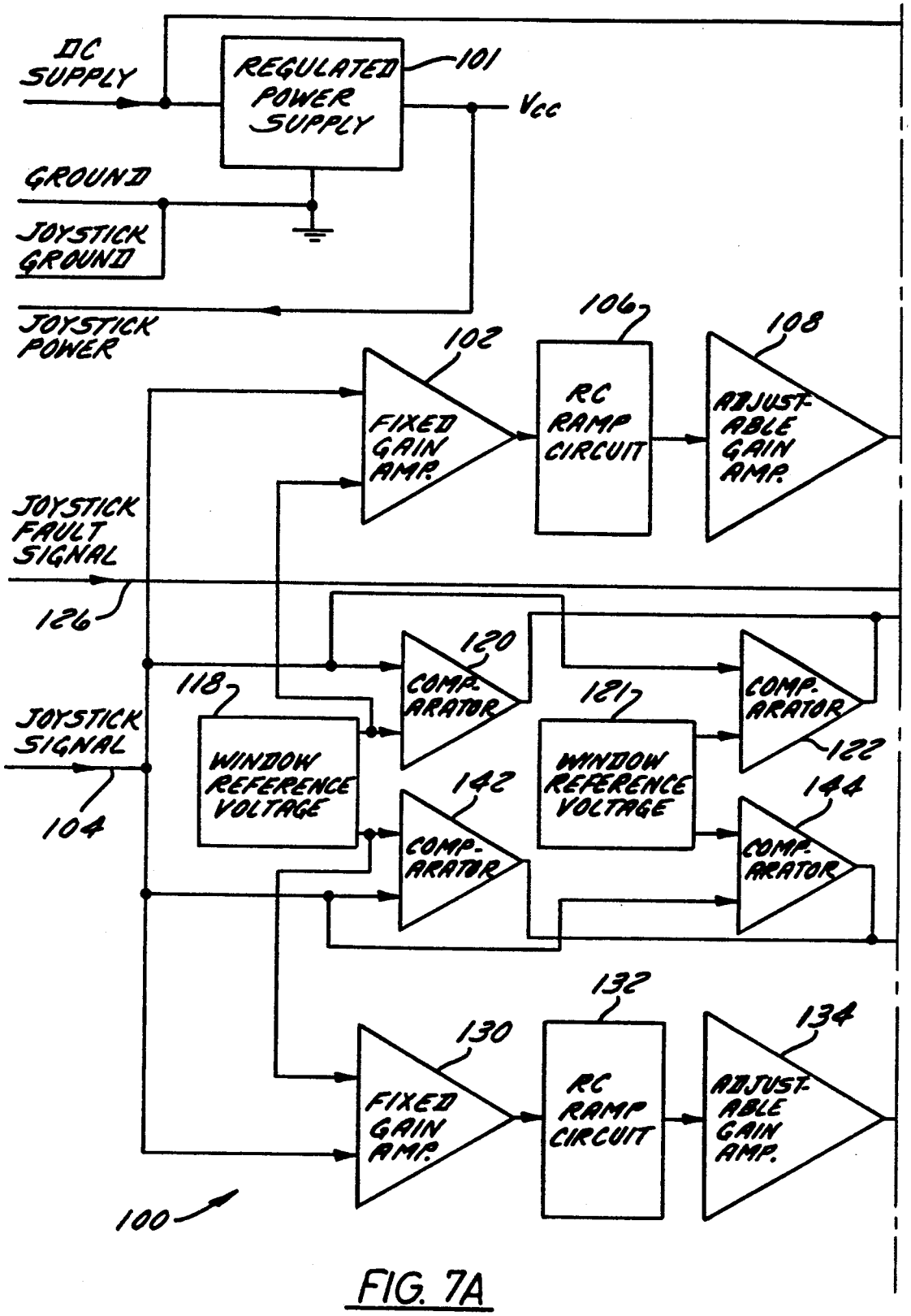
FIGS. 7A and 7B collectively form a block diagram of an analog control circuit usable with the joystick of FIGS. 3-6.
Figure 7B:
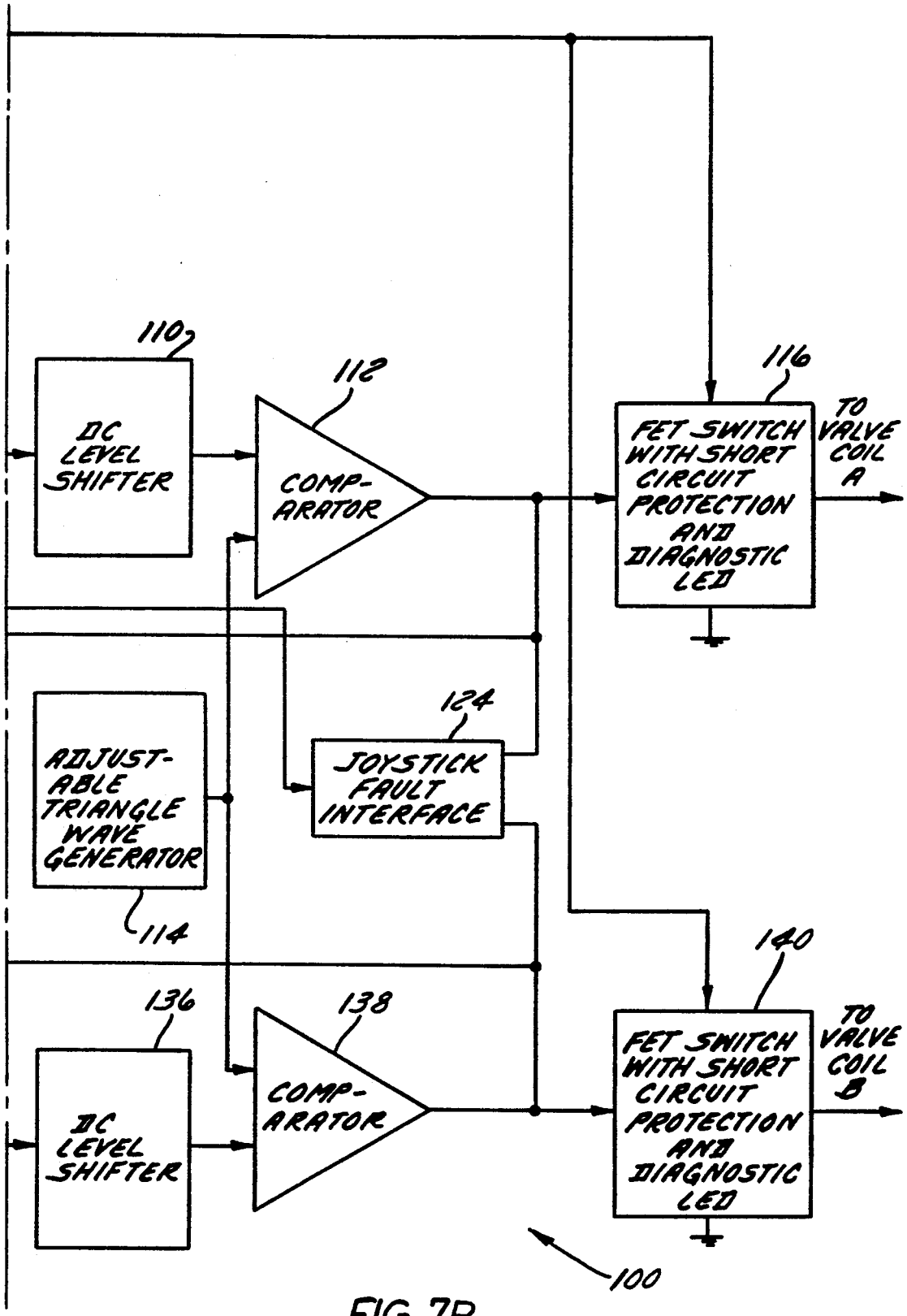

Referring to FIGS. 7A and 7B, a possible analog control system 100 including the circuitry provided on the valve driver 44A supplies power to the joystick from a regulated power supply 101. The contactless detector 42 (FIGS. 3–6) receives this power and outputs a signal 104 from signal wire 52 (FIG. 4) to a fixed gain amplifier 102. Signal 104 is representative of the operational state of joystick lever 34 and, in the case of a linear induction sensor, represents the position of the joystick lever.

Figure 4:
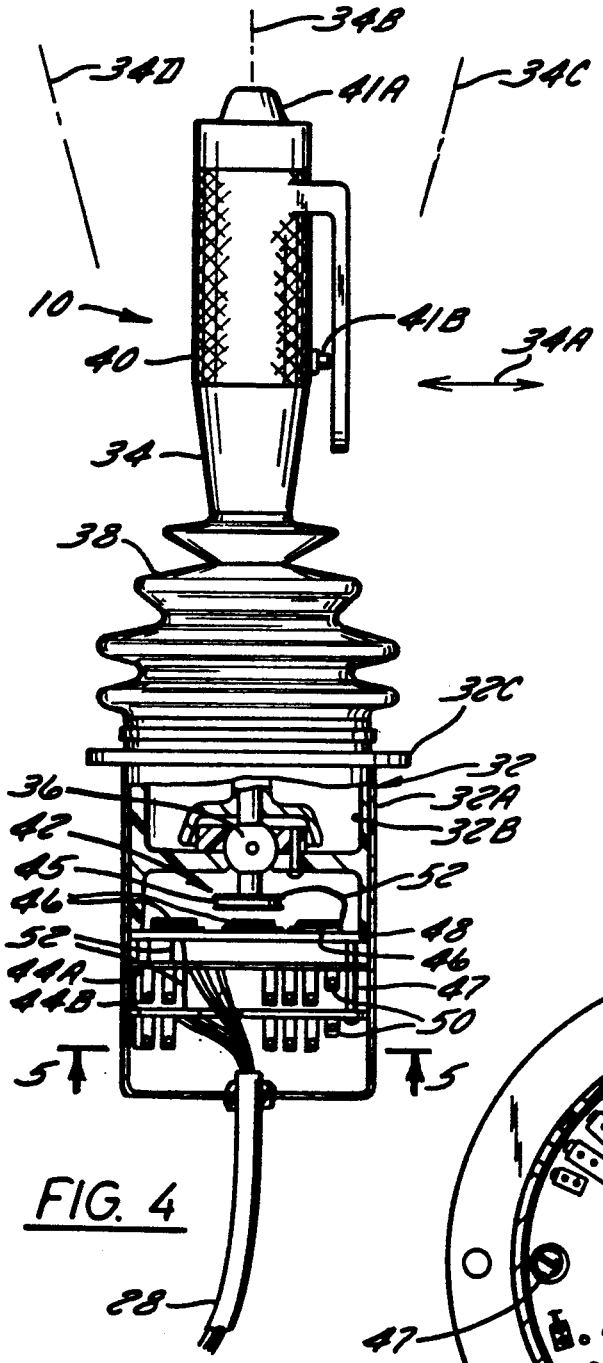
FIG. 4 is an elevation view of the joystick of FIG. 3, shown partially in cross section.
Figure 5:
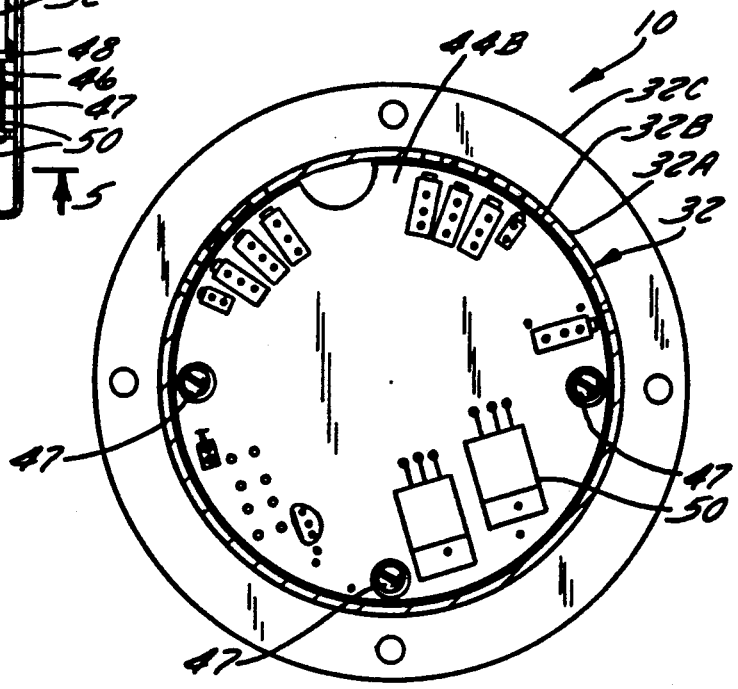
FIG. 5 is a sectional end view of the joystick of FIGS. 3 and 4 taken along the lines 5—5 in FIG. 4.

Amplifier 102 contains a conventional amplifier and also includes a comparator which compares the voltage of signal 104 to fixed reference voltages generated by a window reference voltage generator 118 and determines whether the joystick lever 34 has moved to the left or the right as illustrated in FIG. 4. This comparator functions in the same manner as comparator 120 described in detail below and outputs a signal only if the joystick lever 34 moves to the left, thus indicating that the power to coil 16A of valve 16 is to be adjusted.

Figure 3:
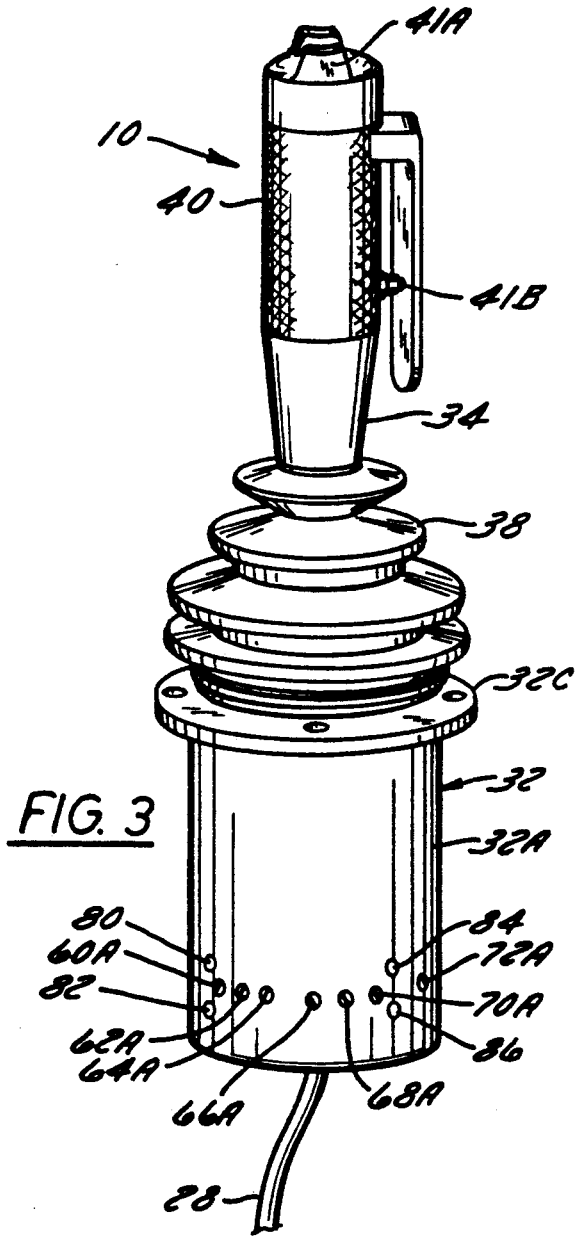
FIG. 3 is a perspective view of one of the joysticks of FIG. 1.

The amplified signal output from amplifier 102 is transmitted to an RC ramp circuit 106 which is adjustable by adjusting screw 60A in FIGS. 3 and 6 to adjust a potentiometer provided in circuit 106. This circuit, as is known in the art, controls the rate at which the output signal can increase or decrease and thus controls the proportional opening or closing rate of the valve.

The signal generated by the RC ramp circuit 106 is then transmitted to an adjustable gain amplifier 108 and amplified to a level the maximum value of which is predesignated by adjustment of a potentiometer controlled by screw 62A in FIGS. 3 and 6. This signal is then transmitted to a dc level shifter circuit 110 which is adjusted via screw 64A and which, as is known in the art, sets the current threshold at which the current to valve coil 16A of valve 16 can be adjusted by adjusting a potentiometer provided in the circuit 110. This signal is transmitted to a comparator 112 and compared with the output of an adjustable triangle wave generator 114 to set the frequency response of the valve coil. The output of this comparator is transmitted to a field effect transistor (FET) switch 116 with short circuit protection and diagnostic LED 80. The function of this switch will be discussed in more detail below.

At the same time, the voltage of signal 104 produced by the contactless detector 42 is compared in a comparator 120 with the fixed reference voltages which are generated by voltage generator 118 and which correspond to the normal tolerances of the rest position of the joystick. This comparator 120 outputs a signal to FET switch 116 only if the voltage of signal 104 is below the lower reference voltage, thus indicating that the joystick lever 34 has been moved beyond its central or neutral position 34B towards the position 34D in FIG. 4.

For instance, if the voltage of signal 104 is 4.0 volts when the joystick is in its neutral position, circuit 118 and comparator 120 would prevent the transmission of a signal to FET switch 116 unless the voltage is below 3.95 volts. The comparator 142 which, as discussed below, is part of the actuation circuit for the second coil 16B of the valve 16, interacts with the circuit 118 in a similar manner but outputs a signal only if the voltage of signal 104 is above 4.05 volts, thus indicating that the joystick lever 34 has been moved beyond its central or neutral position 34A towards the position 34C in FIG. 4.

Circuit 100 also preferably includes devices responsive to a fault in the joystick or of a failure of the signal wire 52 or of other circuitry upstream of valve driver 44A. To this end, the voltage 104 produced by the contactless detector 42 is also compared in a comparator 122 to threshold voltages which are generated by a window reference voltage generator circuit 121 and which correspond to those produceable during normal operation of the joystick. This comparator 122 outputs a signal to FET switch 116 only if the voltage of signal 104 is above the minimum threshold established by this window reference voltage. Voltages below this value would indicate a defect in the form of a short circuit or a break in the signal wire 52 or a defect in other circuitry within the joystick 10 which could otherwise lead to unintended actuation of the valve coil 16A.

For instance, if the minimum voltage normally produceable by detector 42 is 2.5 volts, circuit 121 and comparator 122 would prevent the transmission of a signal to FET switch 116 unless the voltage is above a threshold of, e.g., 2.5 volts. The comparator 144 which, as discussed below, is part of the actuation circuit for the second coil 16B of the valve, interacts with the circuit 121 in a similar manner but outputs a signal only if the voltage of signal 104 is below a second threshold of, e.g. 5.5 volts.

Block 124 represents a joystick fault interface circuit responsive to a joystick fault signal 126 which is, per se, well known. Such a fault signal may be generated, for instance, if there is constant interference generated inside the joystick. Fault interface circuit 124 may comprise a simple diode or any other device which is capable of detecting the presence of joystick fault signal 126 and forwarding a signal to FET switch 116 only in the absence of a joystick fault signal. FET switch 116 permits the transmission of the output signal from comparator 112 to the valve coil 16A only when the comparator 120 indicates that the joystick has moved beyond its center position, when the comparator 122 indicates that the signal wire 52 is not broken or short circuited, and when the joystick fault interface circuit 124 indicates that there is no joystick fault signal.

The second valve coil 16B is controlled by circuitry which is identical to that used to control valve coil 16A and which includes a fixed gain amplifier 130, an RC ramp circuit 132, an adjustable gain amplifier 134, a dc level shifter 136, a comparator 138, and a FET switch 140. All of these devices are identical to the corresponding devices used to control valve coil 16A and will not be disclosed in any more detail. FET switch 140, like FET switch 116, forwards the output from comparator 138 to coil 16B of valve 16 only when comparator 142 indicates that the joystick lever 34 has moved beyond its neutral position, when comparator 144 indicates that the signal line 52 is not broken or short circuited and there are no other discernable defects in the joystick circuitry, and only when joystick fault interface 124 indicates that there is an absence of a joystick fault signal.

2. Digital Control System

Figure 8:
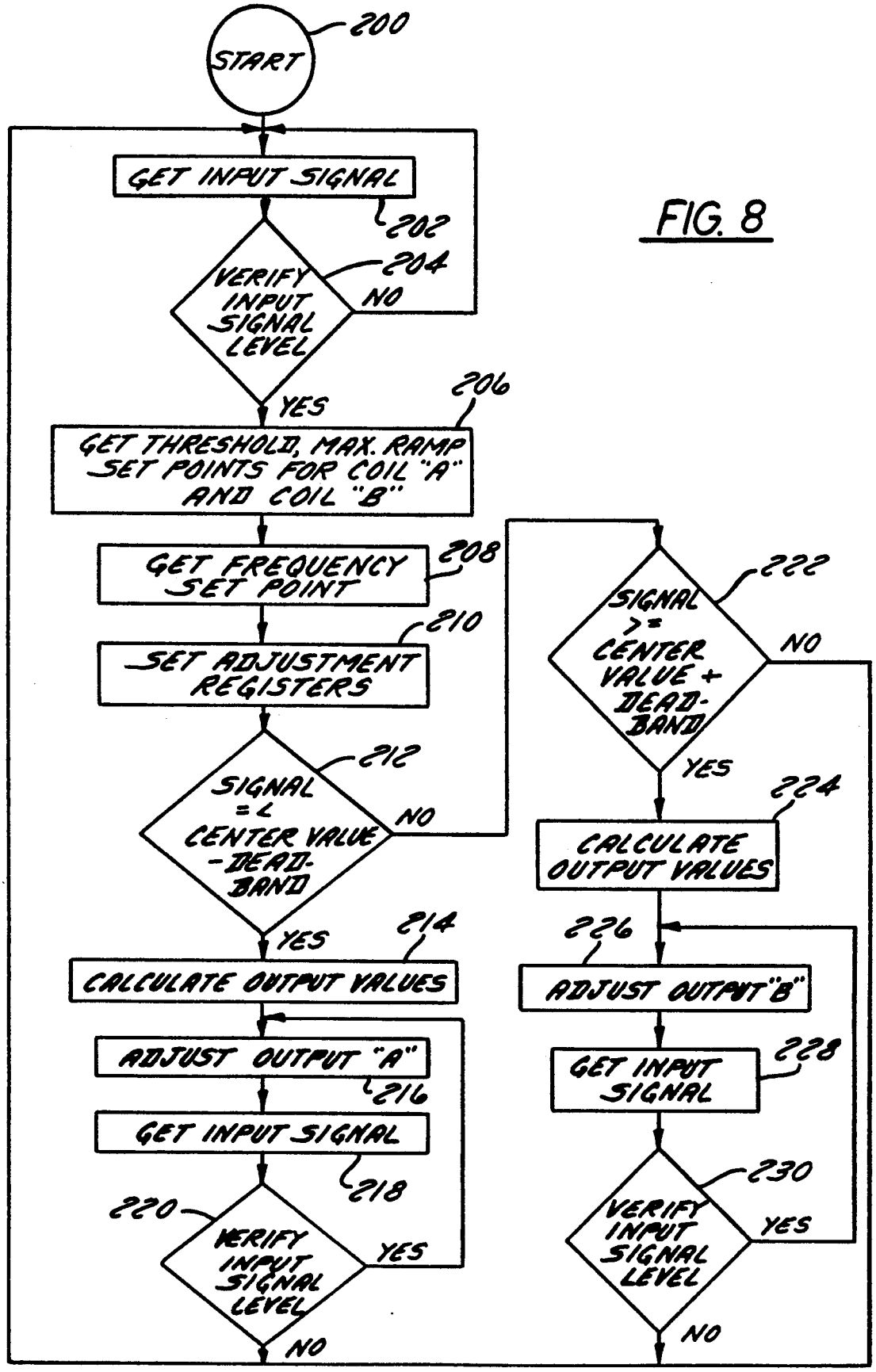
FIG. 8 is a flow chart illustrating the operation of a digital control circuit usable with the joystick of FIGS. 3-6.

Functions similar to those performed by the control circuit of FIGS. 7A and 7B could also be performed digitally in a microprocessor. Referring to FIG. 8, from start at step 200 the signal from the contactless sensor 42 is obtained at step 202 and verified in step 204 by determining whether the signal voltage is in a range which is sufficiently low to preclude a short circuit and sufficiently high to preclude a broken wire. For instance, assuming that the signal obtained in step 202 is 4 volts when the joystick lever 34 is in its neutral position 34B, the process proceeds to step 206 only if the voltage obtained in step 202 is between 2.5 and 5.5 volts.

Assuming that an input signal is verified in step 204, the adjusted threshold, maximum, and ramp currents are obtained for each of the coils 16A and 16B of valve 16 in step 206. It should be noted that the functions performed in this step are functionally analogous to those performed by the RC ramp circuit, the adjustable gain amplifier, and the dc level shifter of the analog embodiment discussed above.

Next, the manually selected frequency set point is selected in step 208, thereby setting the pulse width of the signal to produce the desired pulse frequency in the valve coils. In step 210, the internal registers of the microprocessor are set to reflect those input manually in steps 206 and 208.

In steps 212 and 222, the process determines which coil of the valve is to be controlled. In step 212, the system detects whether the input signal is less than or equal to a predetermined dead band value which is a designated value of, e.g. 0.05 volts less than a central value of, e.g. 4.0 volts.

If the answer to the inquiry of step 212 is yes, an output value to be transmitted to coil 16A is calculated in step 214 based on the magnitude of the input signal obtained in step 202, and this output value is used to adjust the output signal to coil 16A from a neutral level to that required to obtain the desired opening degree of the valve. In step 218, the input signal is again obtained and compared in step 220 with the preexisting input level to determine whether the joystick lever 34 has been moved from the position that it was in when the signal was detected at step 202. If the joystick lever has not moved, thus indicating that the valve port or ports controlled by coil 16A should remain open at the degree corresponding to that desired by the input signal obtained in step 202, the process returns to step 216 and the output of coil 16A remains adjusted to the level determined in step 214. If, on the other hand, the process determines in step 220 that the joystick lever 34 has moved, the process returns to start and steps 202 through 212 are repeated to readjust the output to coil 16A to reflect the changed circumstances.

If in step 212 the process determines that the joystick lever 34 has not been moved in a direction required to actuate coil 16A (i.e., to the left in FIG. 4), the process proceeds to step 222 and determines whether or not the voltage of the signal obtained in step 202 signal is equal to or greater than a predetermined amount of, e.g. 0.05 volts above the central value. The signal voltage will rise above this threshold value when the joystick lever is moved from the neutral position in the direction opposite to that required to adjust coil 16A (i.e., to the right in FIG. 4). If the result of this inquiry is no, the process determines that the joystick lever 34 has not been actuated in either direction and returns to step 202.

If, on the other hand, the process determines in step 222 that the joystick lever has been moved to the right, energization of coil 16B is adjusted in the same manner as that discussed above in connection with coil 16A. Specifically, the output value for coil 16B is calculated in 224, the output is adjusted in 226 to the level calculated in step 224, and the updated signal voltage produced by contactless detector 42 is obtained in step 228 and compared with the original signal voltage obtained in step 202 to determine whether or not the position of the joystick lever 34 has changed. The program returns to step 202 only when the process determines in step 230 that the input signal has changed, thus reflecting movement of the joystick.

The above examples are illustrative of any number of analog and digital circuits which could be provided on valve drivers constructed in accordance with the present invention. Many disclosed functions could be eliminated, and/or other functions could be incorporated. The disclosed functions, including these which respond to joystick faults and those which respond to failure of signal wires, could be performer by a wide variety of digital or analog circuits other than those described. Other modifications and alterations which could be made without departing from the spirit and scope of the present invention will be more readily understood from a reading of the appended claims.

We claim:

1. A method of actuating a proportional valve, comprising the steps of:

(A) moving a joystick actuating lever attached to a joystick housing;

(B) detecting the position of said actuating lever via a contactless detector and generating a detection signal representative of said position;

(C) generating, via a valve driver disposed within said housing, an actuating signal which is responsive to said detection signal generated by said detector; and (D) transmitting said detection signal to said proportional valve.

2. A method according to claim 1, further comprising the step of adjusting an operational parameter of said valve driver by actuating an adjusting device provided in said housing.

3. A direct drive joystick for actuating a proportional valve, comprising:

(A) a housing;

(B) an actuating lever attached to said housing;

(C) a contactless detector which detects an actuating state of said lever and which generates a signal representative of said actuating state; and (D) a valve driver which is responsive to said signal generated by said detector to actuate said proportional valve, said valve driver being disposed within said housing.

4. A direct drive joystick according to claim 3, wherein said contactless detector comprises a linear induction sensor comprising a transmitter coil coupled to said actuating lever and a stationary pickup coil provided in said housing.

5. A direct drive joystick according to claim 3, further comprising a second valve driver disposed within said housing beneath said valve driver.

6. A direct drive joystick according to claim 3, further comprising devices, provided in said housing for adjusting the operational parameters of said valve driver.

7. A direct drive joystick according to claim 6, wherein holes are provided in a side wall of said housing proximate said valve driver, and wherein said devices comprise screws which are aligned with said holes in said side wall of said housing.

8. A direct drive joystick according to claim 3, further comprising a status indicator which is provided in said housing and which provides an indication of the operational status of said valve driver.

9. A direct drive joystick according to claim 8, wherein said status indicator comprises an LED.

10. A direct drive joystick according to claim 3, wherein said valve driver comprises a circuit disposed within said housing beneath said detector.

11. A direct drive joystick according to claim 10, wherein said circuit is hard wired and produces an analog signal.

12. A direct drive joystick according to claim 10, wherein said circuit includes a microprocessor which produces a digital signal.

13. A system comprising:

(A) a housing;

(B) an actuating lever attached to said housing;

(C) a contactless detector which detects an actuating state of said lever and which generates a signal representative of said actuating state; and (D) a valve driver which is responsive to said signal generated by said detector to generate an output signal, said valve driver including at least one of (i) means for preventing said valve driver from generating said output signal in the presence of a signal wire defect, and (ii) means for preventing said valve driver from generating said output signal in the presence of a fault in said system.

14. A system according to claim 13, wherein said valve driver comprises a hard-wired circuit board which produces an analog signal.

15. A system according to claim 14 wherein said means (i) comprises a comparator and a reference voltage circuit connected to said comparator.

16. A system according to claim 14, wherein said means (ii) comprises a joystick fault interface.

17. A system according to claim 13, wherein said valve driver is disposed within said housing.

18. A system according to claim 17, further comprising devices, provided in said housing, for adjusting the operational parameters of said valve driver.

19. A system according to claim 17, further comprising a status indicator which is provided in said housing and which provides a visual indication of the operational status of said valve driver.

20. A system according to claim 19, wherein said status indicator provides a visual diagnostic of said system.

21. A system according to claim 13, further comprising a proportional valve having an electrically activated coil which receives said output signal from said valve driver.

22. A system comprising:

(A) a housing;

(B) an actuating lever attached to said housing;

(C) a contactless detector which detects an actuating state of said lever and which includes a circuit generating a signal representative of said actuating state;

(D) a valve driver which is responsive to said signal generated by said circuit of said detector to generate an output signal, said valve driver being disposed within said housing; and (E) a proportional valve which has an electrically activated coil which receives said output signal from said valve driver, said output signal controlling at least one of the opening and closing rates of said valve and the degree of valve opening.

* * * * *